US005441000A

United States Patent [19]

Vatsky et al.

[11] Patent Number: 5,441,000

[45] Date of Patent: Aug. 15, 1995

[54] SECONDARY AIR DISTRIBUTION SYSTEM FOR A FURNACE

[76] Inventors: Joel Vatsky, 66 Lessing Rd., West Orange, N.J. 07052; Timothy W. Sweeney, 32A Buttermilk Bridge Rd., Washington, N.J. 07882; Lawrence F. Newman, 24 Blauvelt Ave., Dumont, N.J. 07628

[21] Appl. No.: 234,031

[22] Filed: Apr. 28, 1994

[51] Int. Cl.[6] ..... F23D 1/00

[52] U.S. Cl. ..... 110/265; 431/174; 431/178; 431/190

[58] Field of Search ..... 431/174, 178, 190; 110/265, 261, 263

[56] References Cited

U.S. PATENT DOCUMENTS 2,013,565 9/1935 Lundgren .
2,363,875 11/1944 Kreisinger et al. .
2,697,422 12/1954 Armacost .
4,150,631 4/1979 Frey et al. .
4,252,069 2/1981 McCartney .
4,294,178 10/1981 Borio et al. .
4,425,855 1/1984 Chadshay .
4,570,551 2/1986 Derbidge et al. .
4,655,148 4/1987 Winship ..... 110/265
5,020,454 6/1991 Hellewell et al. .
5,195,450 3/1993 Marion .

*Primary Examiner*—Carroll B. Dority

[57] ABSTRACT

A secondary air distribution for a furnace in which an housing is provided for receiving air and a set of dividers are located in the housing for dividing the air passing through the housing into a plurality of streams. A set of dampers are disposed in the housing and are located relative to the dividers for controlling the flow of each of said streams. Additional dividers are provided for splitting each of the streams of air flow and an additional set of dampers are disposed in the housing and are positioned relative to the additional dividers for controlling the flow of each of the split stream portions to the modules.

15 Claims, 2 Drawing Sheets

SECONDARY AIR DISTRIBUTION SYSTEM FOR A FURNACE

FIELD OF THE INVENTION

This invention relates generally to a coal-fired furnace and, more particularly, to a system for supplying secondary air to a furnace utilizing a plurality of burners for discharging pulverized coal into the interior of the furnace.

Many types, arrangements and locations of burners are utilized in coal-fired furnaces. For example, in some designs the burners are mounted relative to the furnace walls in a manner to discharge a mixture of coal and primary air in a direction perpendicular to the walls. Another technique known as tangential firing has evolved which involves the disposition of one or more burners in or near each of the corners of the furnace which fire generally towards the center of the furnace or generally tangentially with respect to an imaginary circle located in the center of the furnace, and secondary air is discharged from one or more air nozzles located adjacent to the respective burners. Tangential firing is quite popular since it achieves good mixing of the coal and the air, relative stable flame conditions and relatively long residence time of the combustion gases in the furnace.

In the above type of arrangements, it is desirable to utilize a plurality of modules, each consisting of at least one burner for discharging a mixture of air and fuel and one or more nozzles in a closely-spaced relationship to the burner for discharging secondary air in a combustion-supporting relationship to the fuel. Several modules are often stacked in a vertically-spaced relationship at each of several location along the furnace walls.

The secondary air is usually delivered to the air nozzles from one or more windboxes which receive the air from an external source, and it is often difficult to deliver the air to the air nozzles in fairly exact quantifies and at predetermined flow rates. This difficultly is compounded in arrangements utilizing several of these modules, and therefore a multiplicity of air nozzles at one location, especially in situations in which the combustion conditions vary at each module requiring the air to be delivered at varying quantities and flow rates to different nozzles.

SUMMARY OF THE INVENTION

It is therefore an object of the present invention to provide a system for distributing a plurality of individual streams of secondary air to a plurality of burner/air nozzle modules in a furnace.

It is another object of the present invention to provide a air distribution system of the above type in which the air flow to each module is precisely and independently controlled.

It is a further object of the present invention to provide a system of the above type is which the air flow to each burner and nozzle of each module can be controlled independently of the flow to the other burner and/or nozzles of the same module.

It is a still further object of the present invention to provide a system of the above type in which a single windbox housing is adapted to supply air to two columns of burner/nozzle assemblies respectively disposed to both sides of the housing, with each column containing a plurality of spaced assemblies.

Towards the fulfillment of these and other objects, the system of the present invention includes an housing for receiving air and a set of dividers for splitting the air flow through said housing into a plurality of streams. A set of dampers are located relative to the dividers for controlling the flow of each of said streams. Additional dividers are provided in the housing for further splitting each of the streams of air flow and an additional set of dampers are disposed in the housing and are positioned relative to the additional dividers for controlling the flow of the latter split streams to the modules.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
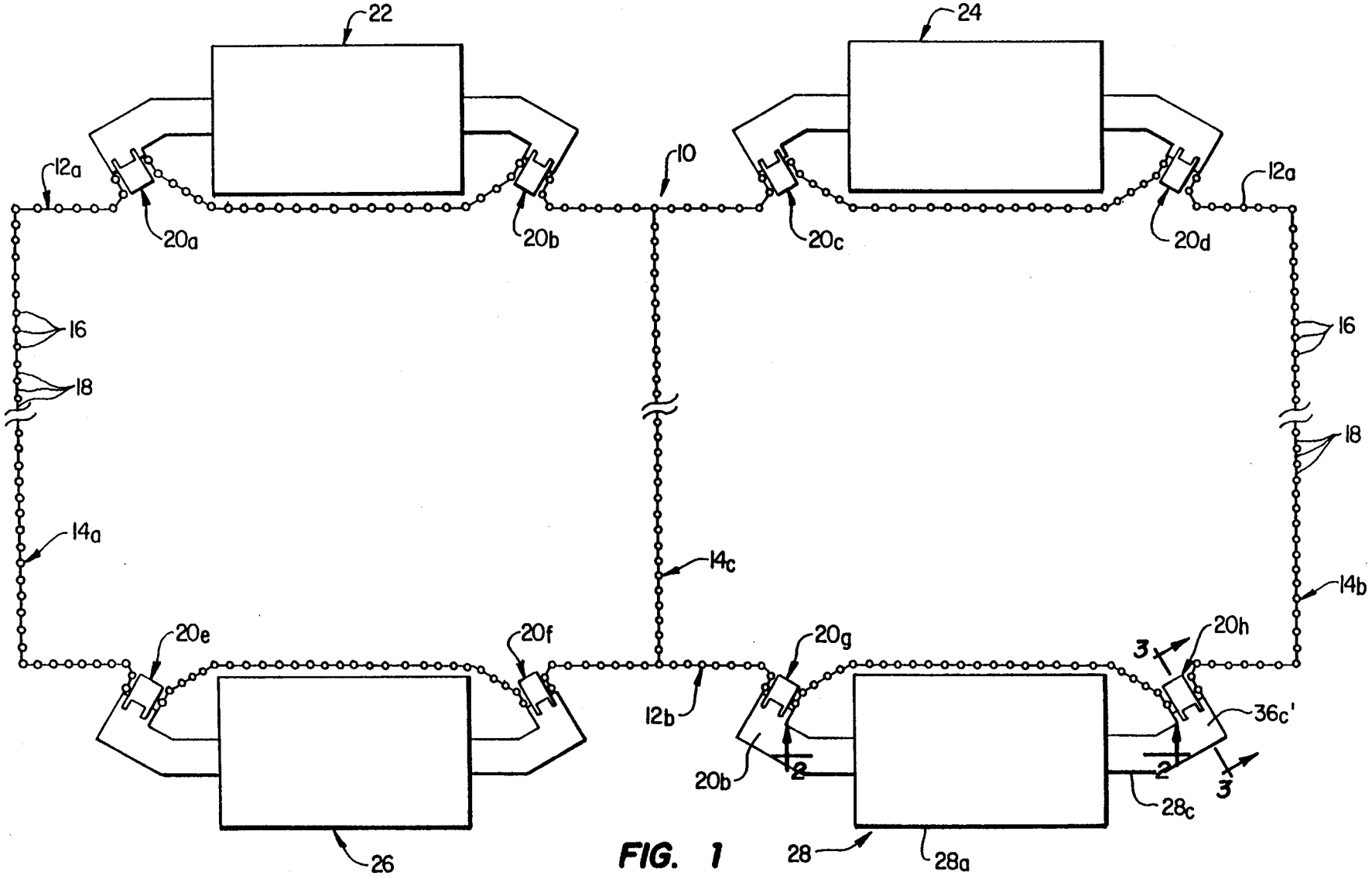
FIG. 1 is a schematic, plan view of a furnace incorporating the air distribution system of the present invention.

Referring to FIG. 1 of the drawings, the reference numeral 10 refers, in general, to a furnace formed by a front wall 12*a*, a rear wall 12*b* and three walls 14*a*, 14*b* and 14*c*. The walls 14*a*, 14*b*, and 14*c* extend in a spaced, parallel relationship and perpendicular to the walls 12*a* and 12*b*, and the wall 14*c* extends midway between the walls 14*a* and 14*b*. Each of the walls 12*a*, 12*b*, 14*a*, 14*b*, and 14*c* are formed by a plurality of vertically-extending, spaced, parallel tubes 16 connected by a plurality of elongated fins 18 extending for the lengths of said tubes in a conventional manner.

Four sections of each of the walls 12*a* and 12*b* are broken away and bent back from the interior of the furnace 10 in order to accommodate four modules 20*a*–20*d* spaced along the wall 12*a* and four modules 20*e*–20*h* spaced along the wall 12*b*. Each module 20*a*–20*h* consists of at least one air/fuel burner extending between two vertically spaced air nozzles, with the number of burners and associated air nozzles in each module varying in accordance with the size of the furnace.

Two spaced windboxes 22 and 24 extend just outside the wall 12*a* with the windbox 22 extending between the modules 20*a* and 20*b*, and the windbox 24 extending between the modules 20*c* and 20*d*. In a similar manner, two spaced windboxes 26 and 28, extend just outside the wall 12*b* with the windbox 26 extending between the modules 20*e* and 20*f* and the windbox 28 extending between the modules 20*g* and 20*h*. The windbox 28 and its relation to the module 20*h* will be described in detail for the purposes of example, it being understood that the description is equally applicable to the other windboxes and their respective modules.

Figure 2:
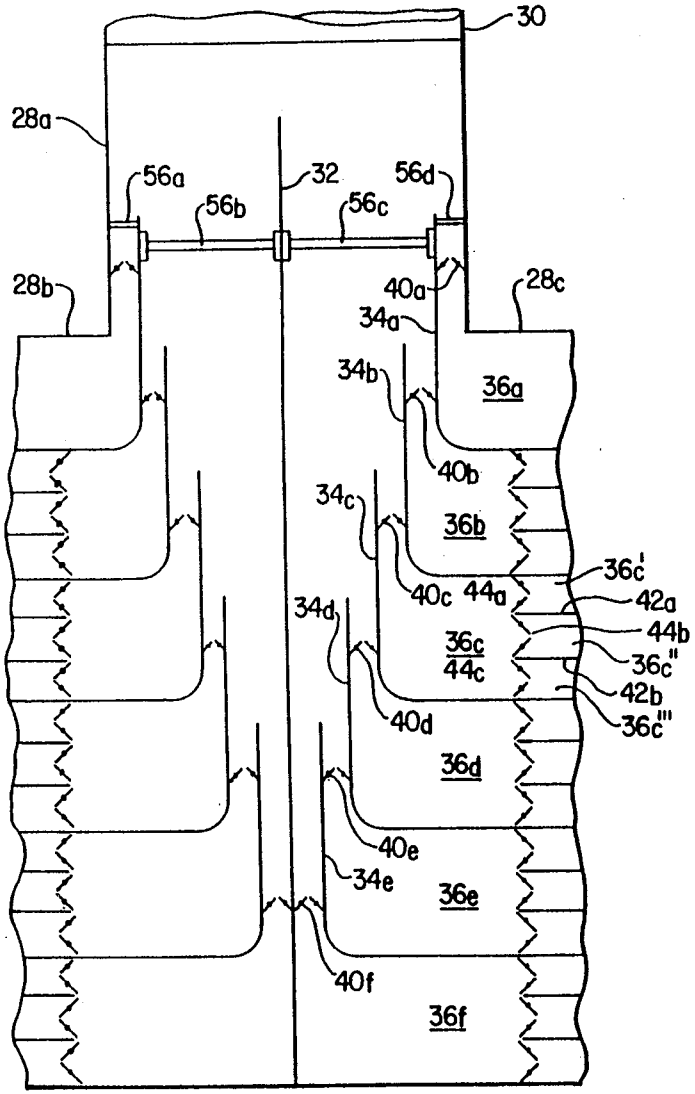
FIG. 2 is a sectional view taken along the line 2—2 of FIG. 1.

As shown in FIGS. 1 and 2, the windbox 28 includes a housing 28*a*, and two subhousings 28*b* and 28*c* extending out from the respective walls of the housing 28*a*. A duct 30 extends from the upper end of the housing 28*a* for introducing the air into the housing in a manner so that the air flows downwardly through the length of the housing, as will be described.

With reference to FIG. 2, a longitudinally-extending divider plate 32 extends for the length of the housing 28*a*, parallel to, and equidistant from, the walls of the latter housing to divide the housing into two sections respectively extending to the left and to the right of the divider plate 32, as viewed in FIG. 2. With reference to the right-hand section of the housing 28*a* and the subhousing 28*c*, five L-shaped divider plates 34*a*–34*e* are disposed in the housing in a staggered, or offset, relationship to form six L-shaped air flow passages 36*a*–36*f* in the housing. The passage 36*a* is formed between the plate 34*a* and the corresponding walls of the housing 28*a* and the subhousing 28*b*, the passage 36*b* is formed between the plates 34*a* and 34*b*, the passage 36*c* is formed between the plates 34*b* and 34*c*, the passage 36*d* is formed between the plates 34*c* and 34*d*, the passage 36*e* is formed between the plates 34*d* and 34*e* and the passage 36*f* is formed between the plate 34*e* and the lower end portion of the divider plate 32 and the lower wall, or floor, of the housing 28. Each of the L-shaped passages 36*a*–36*f* has a vertical portion disposed within the housing 28*a* and a horizontal portion which extends from the housing 28*a* into the subhousing 28*c*.

Six damper assemblies 40*a*–40*f* are disposed in the vertical portions of the passages 36*a*–36*f*, respectively, for controlling the air flow through the latter passage portions. Each damper assembly 40*a*–40*f* is conventional and, as such, consists of two pivotally-mounted damper blades which can be pivoted to vary the effective cross-sectional area of, and therefore the air flow through, the vertical passage portions. It is noted that the passage 36*a* is utilized to direct the air stream passing therethrough to overfire air ports (not shown) extending through the wall of the furnace 10, under control of the damper assembly 40*a*.

A series of divider plates and damper assemblies are disposed on the left-hand side of the divider plate 32 as viewed in FIG. 2. Since these latter plates and assemblies are identical to, and are located in the same relative positions as, the divider plates 34*a*–34*e*, 42*a* and 42*b* and the damper assemblies 40*a*–40*f*, they will not be described in any further detail.

As shown in FIG. 1, the subhousing 28*c*, which includes a portion of the passages 36*a*–36*f*, bends around in the manner shown and receives, in it's end portion, the burner/air nozzle module 20*h*, which for the purpose of example, will be described as being disposed in passage 36*c*. As shown in FIG. 2, a pair of vertically-spaced, horizontally-extending plates 42*a* and 42*b* are disposed in the horizontal portion of passage 36*c* to divide the latter portion into three passages 36*c*′, 36*c*″ and 36*c*‴ in which are respectively disposed three damper assemblies 44*a*, 44*b* and 44*c*. Each damper assembly 44*a*–44*c* is conventional and, as such, consists of two pivotally-mounted damper blades which can be pivoted to vary the effective cross-sectional area of, and therefore the air flow through the passages 36*c*′, 36*c*″ and 36*c*‴. Thus, the air flow through the passages 36*c*′, 36*c*″ and 36*c*‴ can be varied for reasons to be described. Since the passages 36*a*, 36*b*, 36*d*, 36*e*, and 36*f* are identical to the passage 36*c* they will not be described in any further detail.

Figure 3:
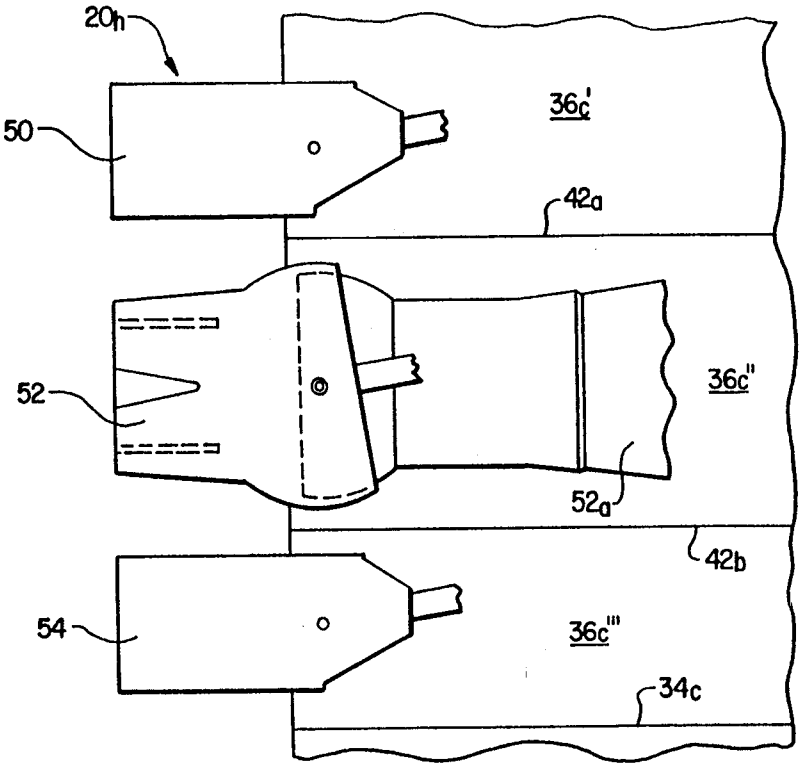
FIG. 3 is a sectional view taken along the line 3—3 of FIG. 1.

As shown in FIG. 3, the module 20*h* consists of a horizontally-extending air nozzle 50 mounted in the passage 36*c*′, a horizontally extending air/fuel burner 52 mounted in the passage 36*c*″ and a horizontally extending air nozzle 54 mounted in the passage 36*c*‴. Thus, the nozzles 50 and 54 extend in a vertically spaced relationship with the burner 52 extending therebetween, and with the nozzles and burner directed into the interior of the furnace 10 (FIG. 1). As shown in FIG. 1, the nozzles and burner of the modules 20*a*–20*h* are directed at an angle to the walls 14*a* and 14*b* of the furnace, which angles can vary in accordance with the particular design. For example, the nozzle and burners can be directed to fire tangentially to an imaginary circle in the center of the furnace, as well known in the art. Also, each burner and nozzle can be tilted about a horizontal axis to vary the height of discharge into the furnace. The details of the nozzles 50 and 54 and the burner 52, and especially the apparatus for mounting and tilting them are described in application Ser. No. 08/288,863, filed Aug. 11, 1994, and assigned to the assignee of the present application. The disclosure of this application is hereby incorporated by reference.

The inlet ends of the nozzles 50 and 54 are open to receive air from the passages 36*c*′ and 36*c*‴, respectively. The burner 52 is connected to an outer barrel 52*a* which, in turn, is connected to a source of an air/fuel mixture (not shown). Thus, the air from the passage 36*c*″ simply passes around the burner 52 before exiting into the furnace and mixing with the mixture of air and fuel discharging from the nozzles 50 and 54. As stated above, the module 20*h* (as well as the other modules 20*a*–20*g*) consists of a burner and two nozzles disposed in each of the passages 36*a*, 36*b* and 36*d*–36*f* in a similar manner.

As shown in FIG. 2, a probe 56*a* is located in the housing 28*a* between the end wall thereof and the vertical portion of the uppermost divider plate (not referenced) on the left-hand side of the divider plate 32. A probe 56*b* extends between the latter vertical portion and the divider plate 32, a probe 56*c* extends between the plate 32 and the vertical portion of the plate 34*a*, and a probe 56*d* extends between the vertical portion of the plate 34*a* and the other end wall of the housing 28*a*. Since the probes 56*a*–56*d* operate in a conventional manner to measure the flow rate of the air passing thereby, they will not be described in detail.

In operation, pressurized air is introduced by the duct 30 into the upper portion of the housing 28*a*, flows over the probes 56*a*–56*d* and is divided into a plurality of discrete streams by the center plate 32, the divider plates 34*a*–34*e* and the identical plates extending to the left of the plate 32. The stream passing through the passage 36*a* is directed to overfire air ports extending above the upper nozzle 50 (FIG. 3) of the uppermost burner module in each module 20–20*h*, while each of the streams 36*b*–36*f* are directed to five modules such as the module 20*h* referenced in FIG. 1 and disposed in the passage 36*c* shown in FIG. 2. Referring again to the passage 36*c* as an example, the stream in the latter passage is divided into three smaller streams 36*c*′, 36*c*″ and 36*c*‴ by the divider plates 42*a* and 42*b* which smaller streams are directed to the nozzle 50, the burner 52 and the nozzle 54, respectively, as shown in FIG. 3. The damper assemblies 40*a*–40*f* and 44*a*–44*c* are adjusted as needed to precisely control the flow of the air in accordance with the particular operational requirements.

It is clear from FIG. 2 that the passages 36*a*, 36*b* and 36*d*–36*f* are divided and function in the same manner as the stream 36*c* as described above, and that the air treatment to the left side of the center plate 32 is the same as just described in connection with the right side. More-over, the windboxes 22, 24 and 26 are provided with the same components as described in connection with the windbox 28 and thus function in the same manner.

The present invention thus enjoys several advantages. For example, it permits independent air flow to each nozzle and burner of each module, while permitting precise control of each individual stream of air. Also, the present invention permits each windbox 22, 24, 26 and 28 to supply air to two groups of burner/air nozzle modules located at the respective sides of each windbox.

It is understood that several variations may be made in the foregoing without departing from the scope of the invention. For example, the specific design of the furnace 10, and especially the location and type of openings for receiving the modules 20*a*–20*h*, as well as the design of the air nozzles 50 and 54 and the burners 52 can vary within the scope of the invention. Also, although the present invention has been described in connection with a tangentially fired furnace 10 it is understood that it is also applicable to other type furnaces. Further, the furnace design is not limited to a fin-tube arrangement but could be in the form of a tangent tube unit with no fins.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. An air distribution system for a furnace, said system comprising a housing for receiving air, two subhousings extending to either side of said housing for receiving said air from said housing, a plurality of discharge devices mounted to each of said subhousings and grouped into modules each consisting of one air/fuel burner for discharging a mixture of said air and fuel into an area of said furnace and two air nozzles respectively extending above and below said burner for discharging said air into another area of said furnace, first divider means for splitting the air flow through said housing into a plurality of streams directed towards said subhousings, first damper means positioned relative to said first divider means for controlling the flow of each of said streams, second divider means for splitting each of said streams of air flow into three portions, two of which respectively enter said air nozzles and one of which flows around said burner, and second damper means positioned relative to said second divider means for controlling the flow of each of said stream portions.

2. An air distribution system for a furnace, said system comprising a housing for receiving air, two subhousings extending to either side of said housing for receiving said air from said housing, a plurality of discharge devices mounted to each of said subhousings for discharging said air and/or a mixture of said air and fuel into two areas of said furnace, a first divider means for splitting said air flow into two parallel streams respectively flowing to said subhousings, second divider means for splitting each of said parallel streams into a plurality of additional parallel streams flowing longitudinally through said housing, first damper means positioned relative to said first and second divider means, means for controlling the flow of each of said streams, third divider means for splitting each of said streams of air flow into a plurality of portions directed towards said discharge devices, and second damper means positioned relative to said third divider means for controlling the flow of each of said stream portions.

3. The system of claim 2 wherein said discharge devices are grouped into modules each consisting of one air/fuel burner and two air nozzles respectively extending above and below said burner, and wherein said third divider means splits each of said streams into three portions, two of which respectively enter said air nozzles and one of which flows around said burner.

4. The system of claim 2 wherein said second divider means also direct said additional parallel streams from said longitudinal flow to a transverse flow across said housing.

5. The system of claim 2 wherein said third divider means are located downstream of said first and second divider means so as to receive said transverse-flowing, additional parallel streams.

6. The system of claim 1 wherein said first divider means comprises a first divider plate for splitting said air flow into two parallel streams respectively flowing to said subhousings and plurality of additional divider plates for splitting each of said parallel streams into a plurality of additional parallel streams flowing longitudinally through said housing.

7. The system of claim 6 wherein said additional divider plates also direct said additional parallel streams from said longitudinal flow to a transverse flow across said housing.

8. The system of claim 6 wherein said second divider means are located downstream of said first divider means so as to receive said transverse-flowing, additional parallel streams.

9. An air distribution system for a furnace, said system comprising a housing for receiving air, a plurality of discharge devices extending to either side of said housing for receiving said air from said housing and for discharging said air and/or a mixture of said air and fuel into two areas of said furnace, first divider means for splitting the air flow through said housing into two streams flowing through said housing in a first direction, second divider means for splitting each of said streams of air flow into a plurality of additional streams and directing said additional streams in a second direction perpendicular to said first direction and towards said discharge devices, and damper means for controlling the flow of said air to said discharge devices.

10. The system of claim 9 wherein said discharge devices are positioned to either side of said housing and wherein said housing includes a main housing for receiving said air and two subhousings extending to either side of said main housing and respectively connecting said main housing to said discharge devices.

11. The system of claim 9 or 10 wherein said discharge devices are grouped into modules each consisting of one air/fuel burner and two air nozzles respectively extending above and below said burners and further comprising third divider means for splitting each of said additional streams into three portions, two of which respectively enter said air nozzles and one of which flows around said burner.

12. The system of claim 10 wherein said first divider means directs a portion of said air to one of said subhousings and a portion of said air to the other subhousing.

13. An air distribution system for a furnace, said system comprising a housing for receiving air, a plurality of discharge devices extending to either side of said housing for receiving said air from said housings and for discharging said air and/or a mixture of said air and fuel into two areas of said furnace, first divider means for splitting the air flow through said housing into two streams and for directing said streams longitudinally through said housing, second divider means for splitting each of said streams into a plurality of additional streams and for directing said additional streams transversely relative to said housing, third divider means for splitting each of said additional streams into a plurality of streams directed towards said discharge devices, and damper means disposed in said housing for controlling the flow of said air.

14. The system of claim 13 wherein said discharge devices are positioned to either side of said housing and wherein said housing includes a main housing for receiving said air and two subhousings extending to either side of said main housing and respectively connecting said main housing to said discharge devices.

15. The system of claim 13 or 14 wherein said discharge devices are grouped into modules each consisting of one air/fuel burner and two air nozzles respectively extending above and below said burners and wherein said third divider means splits each of said additional streams into three portions, two of which respectively enter said air nozzles and one of which flows around said burner.

* * * * *